United States Patent [19]

Brenholts

[11] 4,163,597

[45] Aug. 7, 1979

[54] ELECTRICAL CONNECTOR FOR A SPARK PLUG

[75] Inventor: Alfred R. Brenholts, Houston, Tex.

[73] Assignee: Stitt Spark Plug Company, Conroe, Tex.

[21] Appl. No.: 933,437

[22] Filed: Aug. 14, 1978

[51] Int. Cl.[2] ..... H01R 13/38

[52] U.S. Cl. ..... 339/100

[58] Field of Search ..... 339/26, 100, 223

[56] References Cited

U.S. PATENT DOCUMENTS

| | | | |
|---|---|---|---|
| 2,436,712 | 2/1948 | Burrell et al. | 339/100 |
| 3,560,909 | 2/1971 | Wyatt et al. | 339/100 |
| 3,798,589 | 3/1974 | Deardurff | 339/100 |

*Primary Examiner*—Joseph H. McGlynn

*Attorney, Agent, or Firm*—William S. Rambo

[57] ABSTRACT

A two-part connector for detachably, electrically connecting a high tension lead wire to the terminal post of a spark plug includes threadedly connectable male and female members having cooperative surfaces for clamping the lead wire therebetween, a threaded socket for threaded engagement with the central terminal of the spark plug, and a deformable, annular skirt on the female member engageable with a multi-angular base on the male member to lock the connector against accidental separation.

4 Claims, 3 Drawing Figures

ELECTRICAL CONNECTOR FOR A SPARK PLUG

BACKGROUND OF THE INVENTION

The present invention relates to an improved electrical connector for electrically joining a high tension lead wire to the terminal of a spark plug and for guarding against accidental separation or looseness between the lead wire, the connector, and the spark plug.

In the past, many proposals have been made to reduce the explosion and fire hazards resulting from loose or accidentally disconnected spark plug lead wires of an internal combustion engine. These proposals include the use of electrically shielded ignition wires and spark plugs and/or specially designed dielectric shields and covers for the spark plugs. However, accidental explosions and fires caused by faulty, loose or disconnected lead wires and spark plugs continue to take place particularly with so-called stationary industrial engines which are usually surrounded by a potentially explosive atmosphere.

For example, U.S. Pat. No. 2,301,570 issued to Nowosielski describes a lead wire to a spark plug connector which comprises a female sleeve or nut member into which an insulated lead wire is fitted, with the bared, central conductor strands extending through a reduced diameter opening and into a screw-threaded counterbore, and wherein a male screw-threaded plug member having a pointed nose or end extremity is screwed into the counterbore of the female nut, so as to spread and clamp the strands of the conductor of the lead wire between the pointed end extremity and the female nut member. However, the connector disclosed by the aforesaid U.S. Pat. No. 2,301,570 makes no provision for locking the male and female connector elements together, so that engine vibrations or accidental jarring cannot loosen or separate the parts of the connector.

SUMMARY AND OBJECTS OF THE INVENTION

This invention provides an electrical spark plug connector which includes a pair of threadedly connectable male and female members which are formed with cooperative internal surfaces arranged for clamping engagement with the bared end of an otherwise insulated high tension lead wire, and wherein the male member is threadedly engageable with the central terminal of a spark plug. The female member of the connector is also formed with a bendable cylindrical skirt portion which may be easily deformed into locking engagement with a multi-angular surface on the male member following connection of two members, so as to securely hold and lock the connected members against accidental separation.

The primary object of the present invention is to provide a safety-type electrical spark plug connector which is capable of electrically connecting and securely locking a high tension lead wire to the terminal of a spark plug and which is highly resistant to accidental separation of the lead wire from the spark plug.

DESCRIPTION OF PREFERRED EMBODIMENT

Figure 1:
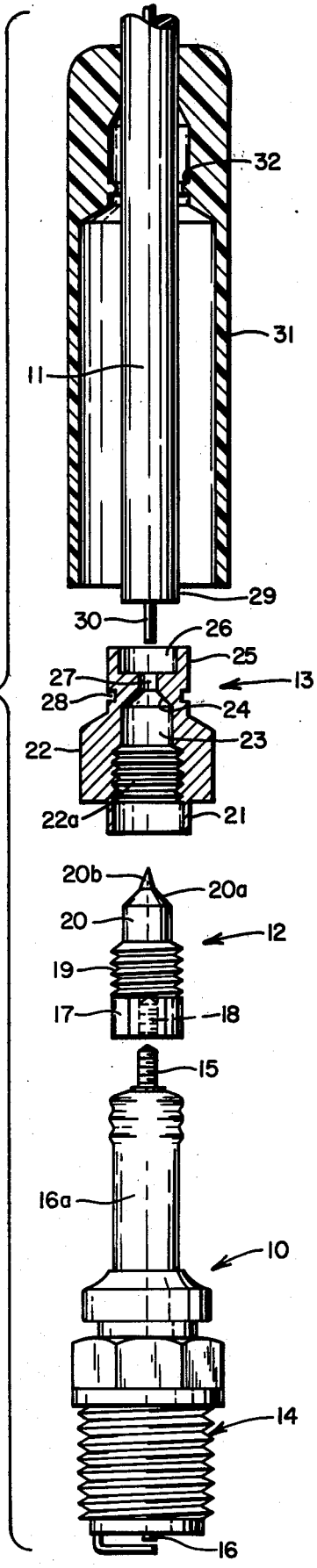
FIG. 1 is an exploded sectional-elevational view illustrating the separate parts of the connector in disassembled relation to a high voltage lead wire and a spark plug.
Figure 3:
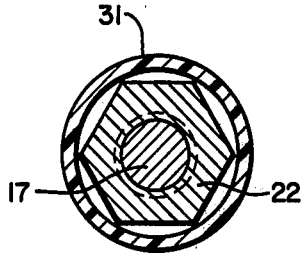
FIG. 3 is horizontal sectional view taken along the line 3—3 of FIG. 2.
Figure 2:
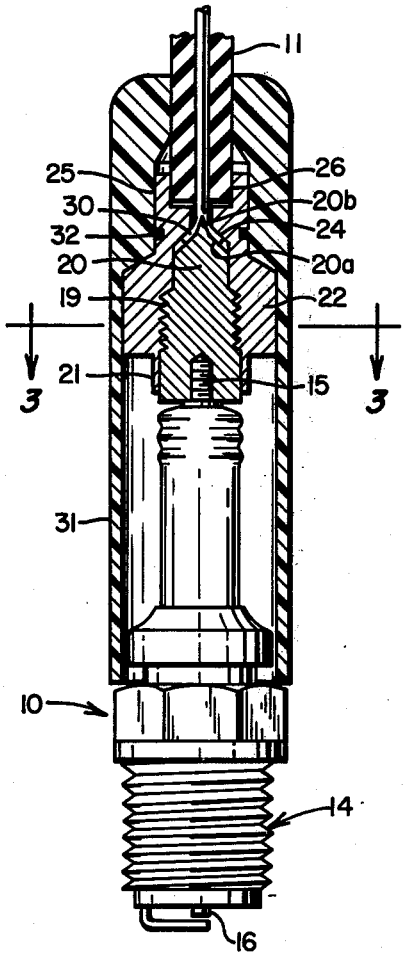
FIG. 2 is a vertical sectional view, partially in elevation, showing the present electrical connector operatively connecting a high tension lead wire with the terminal post of a spark plug.

Referring to the drawing, reference numeral 10 designates generally a spark plug which is arranged for electrical connection with a high voltage lead wire 11 by means of a two-part electrical connector according to this invention. The connector comprises a male member 12 and a female member 13 both composed of an electrically conductive metal or alloy, such as aluminum, copper or brass.

In the usual manner, the spark plug 10 includes an externally threaded base 14 and an externally threaded terminal post 15 which is an integral continuation of the central electrode 16 of the plug. The spark plug also includes a fired ceramic insulator **16*a* which electrically insulates the central electrode 16 from the electrically grounded base 14** of the plug.

The male connector member 12 includes a multiangular, wrench-receiving base section 17 formed with a centrally disposed, axially extending, threaded socket 18 for threaded engagement with the terminal post 15 of the spark plug. Extending upwardly from the base section 17 is an externally threaded, intermediate portion 19 which terminates in a relatively smaller diameter, unthreaded tip portion 20. The tip portion 20 is formed with a beveled outer end surface **20*a* which terminates in a central, upwardly projecting and pointed pintle 20*b***.

The female connector member 13 is formed with an annular, relatively thin walled, cylindrical, but deformable skirt 21. The female member 13 also includes an intermediate portion which is formed with a multiangular, wrench-receiving outer surface 22 and an internal screw threaded socket **22*a* which is sized to threadedly receive the externally threaded intermediate portion 19 of the male connector member 12. The socket 22*a* includes an unthreaded upper chamber 23 to receive the tip portion 20 of the male member 12. The chamber 23 terminates in an annular, beveled seat 24 arranged for relative engagement with the beveled end surface 20*a* of the male connector member 12. The female member terminates in a relatively smaller diameter, cylindrical upper end portion 25 which is formed with an outwardly opening chamber or bore 26, and a relatively smaller diameter, wire-admitting passage 27 which provides communication between the internal chamber 23 and the bore 26 of the female member. The cylindrical outer end portion 25 of the female connector member is formed on its outer surface with a circumferential groove 28**.

The high tension lead wire 11 is of conventional construction and includes an outer insulating covering 29 disposed in surrounding relation to a central, multiple strand metal wire conductor 30.

A protective, dielectric cover or sleeve 31 formed from a suitable, resiliently flexible synthetic resin or rubber may be provided for covering and sealing the assembled connector and the adjoining portions of the spark plug and lead wire against the entrance of moisture and extraneous matter.

In operation, the connector is assembled as follows: first, the male connector member 12 is secured to the spark plug by threaded engagement of the socket 18 of the male member with the terminal post 15 of the spark plug. Next, the protective cover or shield 31 is slid upwardly on the lead wire 11 to an out of the way position, as indicated in FIG. 1. A portion of the outer insulating cover 29 of the lead wire is then cut away to expose or bare the end of the stranded conductor 30. The female member 13 of the connector is then positioned on the bared end of the lead wire 11 with the strands of the conductor 30 extending through the opening 27 into the chamber 23 of the female member, and with the outer end of the insulating covering 29 of the lead wire 11 disposed within the counterbore 26. The female member 13 is then threadedly engaged with the male member 12 while holding the bared end of the lead wire in the opening 27 of the female member. As the female member or nut 13 is tightened downwardly upon the male member 12, the pointed pintle **20*b* on the end of the male member enters into and between the strands of the metal conductor 30 of the lead wire to spread them relatively apart and into outwardly flared engagement with the beveled seat 24 of the female member. Continued tightening of the female nut member 13 onto the male member 12 causes the beveled end portion 20*a* of the male member to come into contact with the separated strands of the metal conductor, and securely clamp and wedge them between the beveled seat 24 of the female member and the beveled end surface 20*a* of the male member. Tightening of the female nut member 13 onto the male member may be facilitated by the application of a pair of wrenches, not shown, to the multiangular base 17 of the male member and to the multiangular outer surface 22 of the female member 13**.

When the female nut member 13 is fully tightened upon the male member 12, a pair of pliers may be applied to the thin walled, deformable skirt 21 of the female member so as to bend the skirt into relatively flattened conformity to the multi-angular base surface 17 of the male member, and thus establish a non-rotative connection between such members. Finally, the outer protective sleeve 31 is slid downwardly over the lead wire 11 to a position at which it telescopes over the assembled connector, and the insulator 16 of the spark plug 10, and the adjoining end portion of the lead wire 11. Toward this end, the outer protective cover 31 is preferably formed with an internal chamber which is sized to snuggly fit over the assembled connector and exposed portion of the spark plug, and the cover may advantageously be formed with a radially inwardly projecting, annular rib 32 which is arranged to snap into and engage with the annular groove 28 formed in the upper end portion 25 of the female member 13, when the protective cover is moved to its desired protective position over the connector and spark plug.

When it is desired to disconnect the male and female members of the connector, such as might be required upon a change of spark plugs, a wrench is applied to the multiangular wrench receiving surface 22 of the female member, while holding the male member 12 against rotation with another wrench, and by applying counterclockwise rotation to the female member 13 so as to reform the deformable skirt 21 back into generally cylindrical configuration. Alternatively, the thin walled skirt portion 21 of the female nut member 13 may be cut or broken away to permit the female member 13 to be unscrewed from the male member 12. However, as will be readily apparent, the male and female components of the connector are normally held against accidental separation such as might otherwise be caused by engine vibration forces, by simply distorting or deforming the skirt 21 of the female member into engagement with the flatted multiangular wrench-receiving surfaces 17 of the male member.

In view of the foregoing, it will be seen that the present invention provides a structurally simple, yet mechanically efficient electrical connector for securely fastening the end of a high tension lead wire to the terminal post of an engine installed spark plug.

While a single preferred embodiment of this invention has been illustrated and described in detail, it will be understood that various modifications in details of construction and design are possible without departing from the spirit of the invention or the scope of the following claims.

I claim:

1. A two-piece electrical connector for detachably, electrically connecting a lead wire with the terminal of a spark plug, comprising:

(a) an electrically conductive male member having:
  (i) a multiangular base portion formed with an axially disposed socket to receive the terminal of a spark plug,
  (ii) an externally threaded intermediate portion, and
  (iii) a pointed outer tip portion; and (b) an electrically conductive female member having:
  (iv) an opening at one end thereof to receive a bared end of a lead wire,
  (v) an internal chamber communicating with the lead wire-receiving opening and terminating at one end thereof in an annular, beveled seat disposed in adjacent, surrounding relation to said lead wire-receiving opening,
  (vi) an intermediate, internally threaded socket adjoining said chamber, and
  (vii) an annular, deformable skirt formed on the end of said female member opposite the lead wire-receiving opening thereof;

said male and female members being detachably connectable by threaded engagement of their threaded intermediate portions, the tip portion of said male member being arranged to clamp the bared end of said lead wire against the beveled seat of said female member upon full threaded engagement of said male and female members, and the skirt of said female member being deformable about the multiangular base portion of said male member to hold said male and female members against accidental detachment.

2. An electrical connector according to claim 1, wherein the axially disposed socket formed in the multiangular base portion of said male member is internally threaded.

3. An electrical connector according to claim 1, wherein said female member is formed adjacent the lead wire-receiving opening thereof with a counterbored socket to receive an outer, insulating covering on said lead wire.

4. An electrical connector according to claim 1, including a resiliently deformable, dielectric sleeve for covering said connector and the adjoining portions of said spark plug and lead wire.

* * * * *